US007654209B2

(12) United States Patent
Park

(10) Patent No.: US 7,654,209 B2
(45) Date of Patent: Feb. 2, 2010

(54) EMBROIDERY MACHINE

(75) Inventor: Chan Soo Park, Seoul (KR)

(73) Assignee: Sunstar Precision Co., Ltd., Incheon (KR)

( * ) Notice: Subject to any disclaimer, the term of this patent is extended or adjusted under 35 U.S.C. 154(b) by 0 days.

(21) Appl. No.: 12/044,273

(22) Filed: Mar. 7, 2008

(65) Prior Publication Data

US 2008/0216720 A1 Sep. 11, 2008

(30) Foreign Application Priority Data

Mar. 8, 2007 (KR) ..... 10-2007-0023139

(51) Int. Cl.
*D05B 69/30* (2006.01)
*D05B 29/00* (2006.01)
*D05B 27/00* (2006.01)

(52) U.S. Cl. ..... 112/220; 112/221; 112/235

(58) Field of Classification Search ..... 112/220, 112/221, 284, 235–239
See application file for complete search history.

(56) References Cited

U.S. PATENT DOCUMENTS 4,716,846 A * 1/1988 Schneider et al. ..... 112/239
5,373,795 A * 12/1994 Kato ..... 112/236
5,590,614 A * 1/1997 Murata et al. ..... 112/237
6,170,414 B1 * 1/2001 Kaetterhenry et al. ..... 112/117
6,591,769 B1 * 7/2003 Heidtmann et al. ..... 112/237

* cited by examiner

*Primary Examiner*—Ismael Izaguirre
(74) *Attorney, Agent, or Firm*—LRK Patent Firm

(57) ABSTRACT

An embroidery machine includes a sewing arm having an upper shaft for providing a driving force, a needle bar support case, which is assembled to a front portion of the sewing arm so as to be laterally movable, a needle bar provided in a needle bar support case, the needle bar having a needle at a lower end thereof and vertically carrying the needle using a rotation driving force of the upper shaft, and a presser foot, which is provided in the needle bar support case so as to be vertically movable, characterized in that each of the needle bar and the presser foot is operated by an individual drive mechanism. The presser foot is separately driven by its own drive source, independent of the drive source of the needle bar.

13 Claims, 10 Drawing Sheets

EMBROIDERY MACHINE

BACKGROUND OF THE INVENTION

1. Field of the Invention

The present invention relates to embroidery machine, and more particularly, to an embroidery machine, in which a presser foot (a cloth pressing member) can be separately driven by its own drive source, independently from the drive source of a needle bar.

2. Description of the Related Art

Generally, an embroidery machine is a biaxial positioning control machine in which an embroidery stitch frame for fixing fabric undergoes horizontal motion in x-axis and y-axis directions while a needle bar thereof moves up and down.

Since this embroidery machine does needlework while the embroidery stitch frame, fixing the fabric, is transferred in x-axis and y-axis directions, the precise and constant-speed movement of the embroidery frame has a close relationship to the quality of an embroidered pattern.

Accordingly, a drive source of the embroidery machine, which transfers the needle bar in vertical directions and the embroidery stitch frame in the x-axis and y-axis directions, is generally implemented with a servo motor, which can be precisely controlled, or a motor, the position of which can be controlled.

FIG. 1 is a perspective view illustrating of the embroidery machine and partially expanded view of sewing head, FIG. 2A is a perspective view illustrating a drive structure for a presser foot and a needle bar of the embroidery machine of the prior art, and FIG. 2B is an expanded view of part "A" of FIG. 2A.

As shown in FIG. 1, a plurality of sewing heads 2 is fixedly arranged in the front portion of an upper beam of an embroidery machine 1 along the length thereof. In each of the sewing heads 2, an upper shaft (not shown) is arranged to laterally extend through a sewing arm 3, and a needle bar support case 4 is assembled to the front portion of the sewing arm 3 in such a fashion that the needle bar support case 4 is laterally movable.

In the lower portion of the needle bar support case 4, a plurality of presser feet 5 (so-called cloth pressing members), which act to prevent a sheet of cloth to be sewn from coming loose when it is being sewn, is provided. Each of the presser feet 5 is set to be vertically movable in cooperation with a needle bar (see the reference number 18 in FIG. 2A).

The needle bar 18 is set to be vertically movable using the rotation driving force of an upper shaft motor (not shown), and a needle (not shown), which forms sewing eyes in the sheet of cloth to be sewn, is mounted on the lower end of the needle bar 18.

Now the drive structure for the presser foot 5 and the needle bar 18 will be described more fully with reference to FIGS. 2A and 2B. A needle bar driving cam 10 is attached to the outer circumference of an upper shaft, which rotates using the rotation driving force of the upper shaft motor.

A needle bar driving rod 11 is mounted on the outer periphery of the needle bar driving cam 10 in such a fashion that the needle bar driving rod 11 is vertically displaceable in response to the amount of eccentricity of the needle bar driving cam 10.

The needle bar driving rod 11 is connected to an intermediate portion of a needle bar drive lever 12. Accordingly, the needle bar drive lever 12 can vertically pivot around a predetermined rotation point by a predetermined amount corresponding to the amount of eccentricity of the needle bar driving cam 10.

The needle bar drive lever 12 is connected, by a needle bar link (not shown), to a needle bar drive block 13, which is vertically movable on a needle bar guide shaft 15, so that the needle bar drive block 13 can vertically move to the extent that the needle bar drive lever 12 rotates.

A needle bar controlling block 14, which is rotatably provided inside the needle bar drive block 13, can be coupled to or decoupled from a needle bar holder 17*a*, which is fastened to the outer circumference of the needle bar 18. A presser foot holder 6 is mounted on the outer circumference of the needle bar 18 under the needle bar holder 17*a*, in such a fashion that it can move vertically.

A spring 19 having a predetermined elastic force is mounted between the needle bar holder 17*a* and the presser foot holder 6, and cooperates with the needle driver 18 in order to drive the presser foot 5.

The presser foot holder 6 is fixedly fastened with the presser foot 5, which prevents the sheet of cloth to be sewn from coming loose while it is being sewn. Now the drive structure for the needle bar 18 and the presser foot 5, as constructed above, will be described in more detail.

The driving force of the upper shaft rotates the motor upper shaft, which in turn rotates the needle bar driving cam 10 fastened to the upper shaft, so that the needle bar driving rod 11, the needle bar drive lever 12 and the needle bar drive block 13 operate cooperatively.

In a position where the needle bar holder 17*a*, which is fixedly fastened to the outer circumference of the needle bar 18, and the needle bar controlling block 14, which is inserted into the needle bar drive block 13, are coupled with each other, the needle bar 18 vertically reciprocates in response to the vertical movement of the needle bar drive block 13. Here, the presser foot holder 6, fastened to the presser foot 5, operates using the elastic force of the spring 19.

That is, the needle bar holder 17*a*, which moves downward, generates a pressing force on the spring 19, thereby pressing down the presser foot holder 6. Then, the presser foot 5, fastened to the presser foot holder 6, moves downward in cooperation with the needle bar 18.

Conversely, when the needle bar holder 17*a* moves upward, the pressing force on the spring 19 is released, so that the needle bar holder 17*a* on the lower end of the needle bar 18 pulls the presser foot 5 upward, thereby moving the presser foot 5 upward.

The conventional drive structure for the presser foot 5, as described above, does not have a driving source, but operates in cooperation with the movement of the needle bar 18. Accordingly, there are problems in that an operator or a user cannot freely change some parameters of the presser foot 5, such as the stroke (i.e., the distance between the top dead point and the bottom dead point), the bottom dead point, and the moving track.

During the downward movement of the presser foot 5, the presser foot holder 6 contacts the outer surface of the needle bar support case 4 to stop the presser foot 5. However, the contact between the needle bar support case 4 and the presser foot holder 6 produces noise upon impact. Furthermore, since contact is frequent, the presser foot holder 6 is constantly vulnerable to damage.

SUMMARY OF THE INVENTION

The present invention has been made to solve the foregoing problems with the prior art, and therefore the present invention provides an embroidery machine, which has a separate drive structure for a presser foot, so that the stroke or the lower end point of a presser foot can be freely changed and the moving track of the presser foot can be freely generated.

The present invention also provides an embroidery machine, which has a height adjustment mechanism for a presser foot, so that the height of the presser foot can be adjusted according to the type or thickness of the sheet of cloth to be sewn.

According to an aspect of the present invention, there is provided an embroidery machine, which includes a sewing arm having an upper shaft for providing a driving force, a needle bar support case, which is assembled to a front portion of the sewing arm so as to be laterally movable, a needle bar provided in a needle bar support case, the needle bar having a needle at a lower end thereof and vertically carrying the needle using a rotation driving force of the upper shaft, and a presser foot, which is provided in the needle bar support case so as to be vertically movable, characterized in that each of the needle bar and the presser foot is operated by an individual drive mechanism.

In the embroidery machine of the invention, the presser foot drive mechanism may include a presser foot drive cam, which is fastened to the upper shaft so as to be rotated thereby; a presser foot drive cam transmission member, which is coupled with the outer circumference of the presser foot drive cam so as to be rocked thereby; a presser foot drive lever, which is connected to the presser foot drive transmission member so as to vertically pivot about a pivot point; a presser foot drive link, which vertically reciprocates according to the amount that the presser foot drive lever pivots; and a presser foot drive block, which reciprocates along a needle bar guide shaft in cooperation with vertical movement of the presser foot drive link.

In the embroidery machine of the invention, the presser foot drive cam transmission member may be a cam roller, which is in contact with a cam follower, the cam follower provided on the presser foot drive cam, or a drive rod, which is coupled with the outer circumference of the presser foot drive cam.

In the embroidery machine of the invention, the presser foot drive block may further include a presser foot holder gripper, which is fastened to a presser foot holder, wherein the presser foot holder is coupled with the outer circumference of the needle bar so as to be vertically slidable thereon.

In the embroidery machine of the invention, the presser foot drive block may include a buffer spring, which is coupled with the outer circumference of the needle bar guide shaft so as to be vertically reciprocable thereon together with the presser foot holder gripper.

In the embroidery machine of the invention, the presser foot holder gripper may be installed inside the presser foot drive block so as to be rotatable about the needle bar guide shaft, thereby being capable of coupling with or decoupling from the presser foot.

In the embroidery machine of the invention, the presser foot holder may be connected to a presser foot assembly, which is provided parallel to the needle bar and is vertically movable.

In the embroidery machine of the invention, the presser foot assembly may include a presser foot guide bushing, which is fastened to the presser foot holder; and a presser foot support, which is coupled at an upper end thereof with the presser foot guide bushing and at a lower end thereof with the presser foot.

In the embroidery machine of the invention, the presser foot assembly may further include a coupling bushing, which supports and fixes both the presser foot support and the needle bar.

In the embroidery machine of the invention, the presser foot may be detachably coupled with the lower end of the presser foot support.

In the embroidery machine of the invention, the presser foot drive mechanism may further include a presser foot height adjustment mechanism, which displaces the pivot point of the presser foot drive lever in a predetermined direction, thereby adjusting the height of the upper end point or the lower end point of the presser foot.

In the embroidery machine of the invention, the presser foot height adjustment mechanism may include a drive motor for generating a driving force; a drive pulley, which is operably coupled with a motor shaft of the drive motor; a follower pulley, which is connected to and rotates following the drive pulley; and an eccentric member having a drive shaft at one portion thereof and a fastening protrusion at the opposite central portion thereof, the fastening protrusion eccentrically protruding from the central portion, wherein the drive shaft is connected to the follower pulley and the fastening protrusion is connected to the pivot point of the presser foot drive lever, so that the eccentric member displaces the pivot point of the presser foot drive lever using the driving force from the drive motor.

In the embroidery machine of the invention, the presser foot height adjustment mechanism may further include an eccentric member support having a hollow space in the central portion thereof, through which the drive shaft of the eccentric member extends.

BRIEF DESCRIPTION OF THE DRAWINGS

The above and other objects, features and other advantages of the present invention will be more clearly understood from the following detailed description, taken in conjunction with the accompanying drawings, in which.

DETAILED DESCRIPTION OF THE INVENTION

Hereinafter, an embroidery machine according to the present invention will be described more fully with reference to the accompanying drawings.

Figure 3:
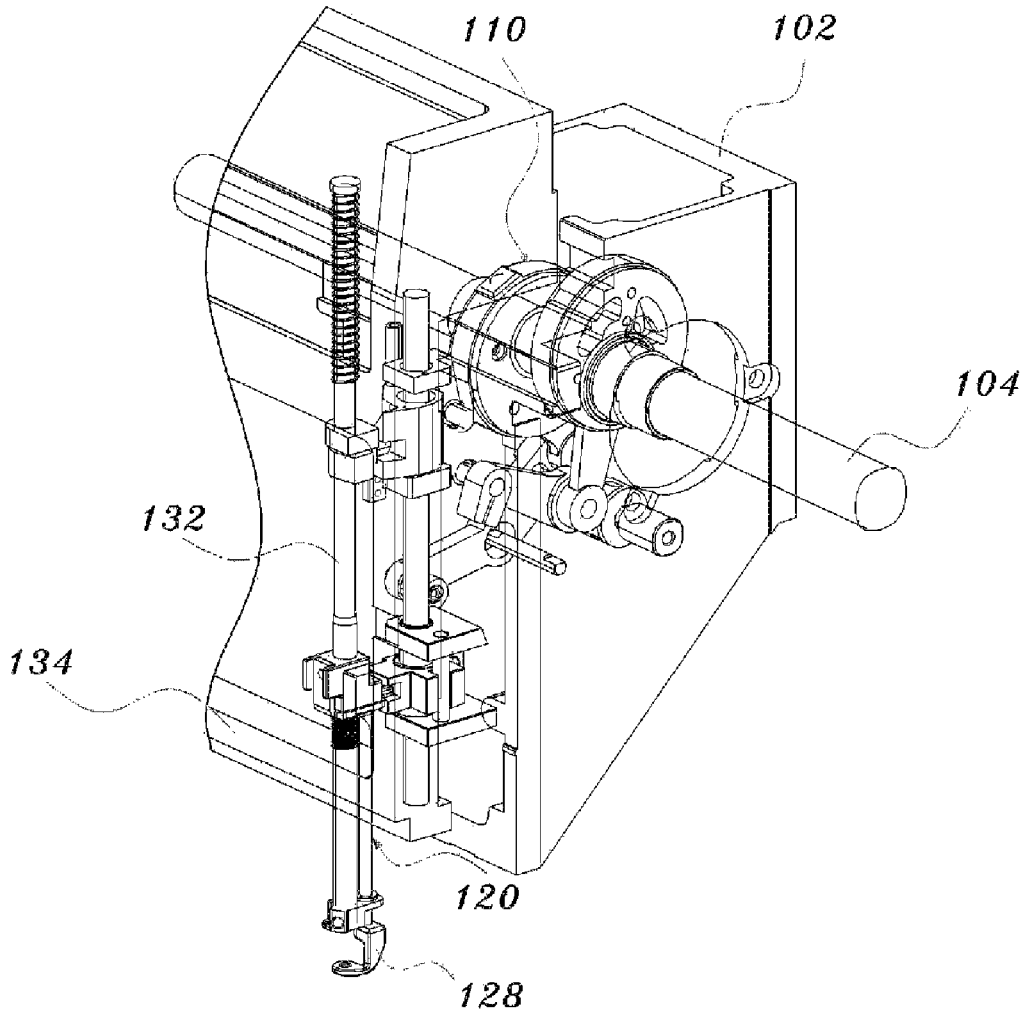
FIG. 3 is a perspective view illustrating a sewing head having a drive structure for a presser foot according to an embodiment of the present invention.
Figure 4A:
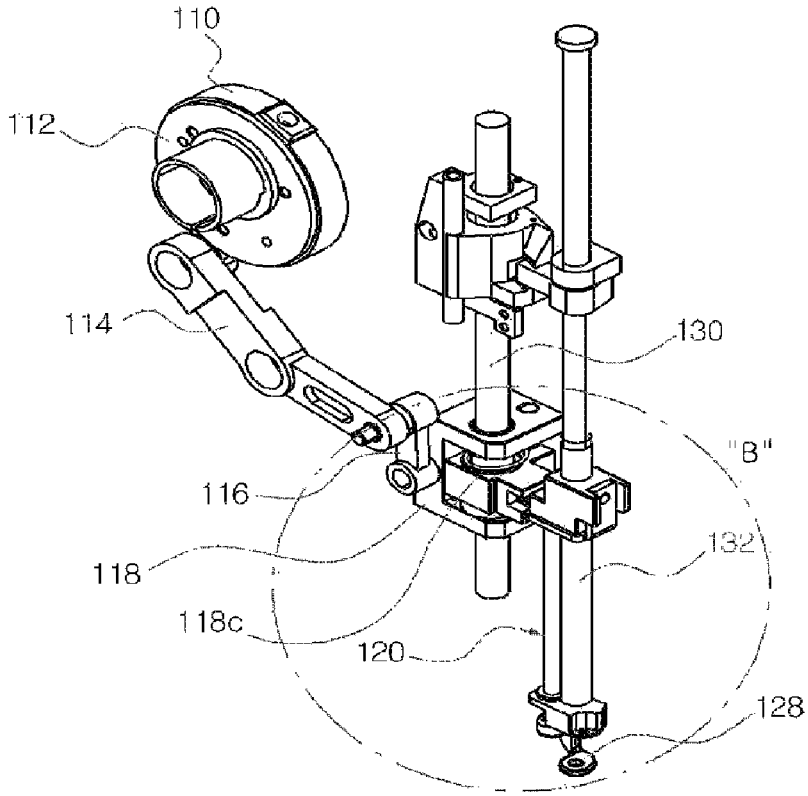
FIG. 4A is a perspective view illustrating the drive structure for a presser foot according to the present invention.
Figure 4B:
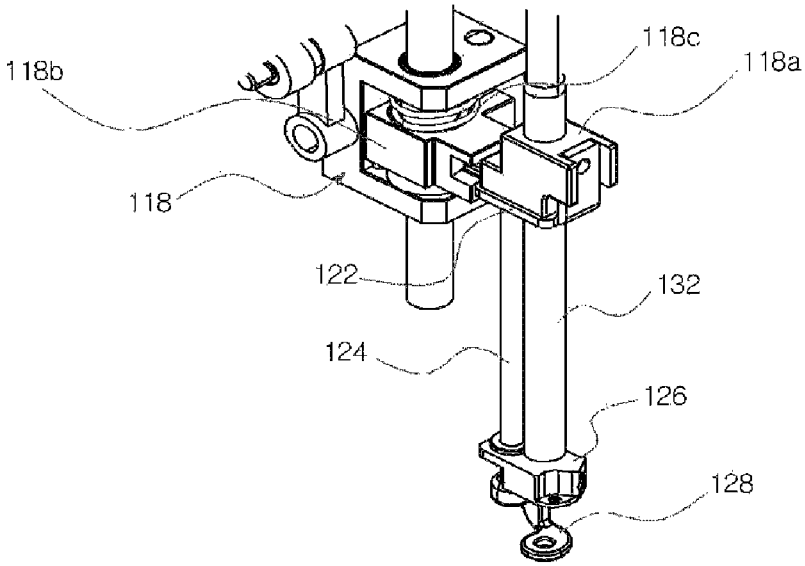
FIG. 4B is an expanded view of part "B" of FIG. 4A, seen from one direction.
Figure 4C:
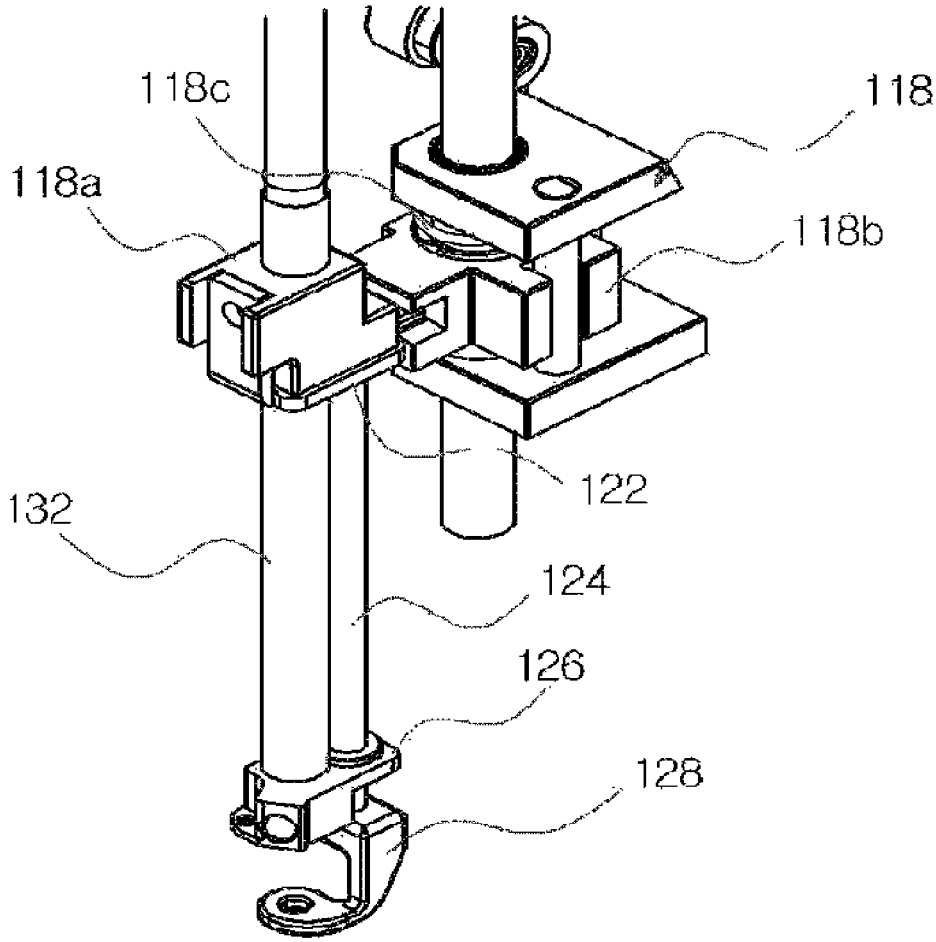
FIG. 4C is an expanded view of part "B" of FIG. 4A, seen from the other direction.
Figure 5:
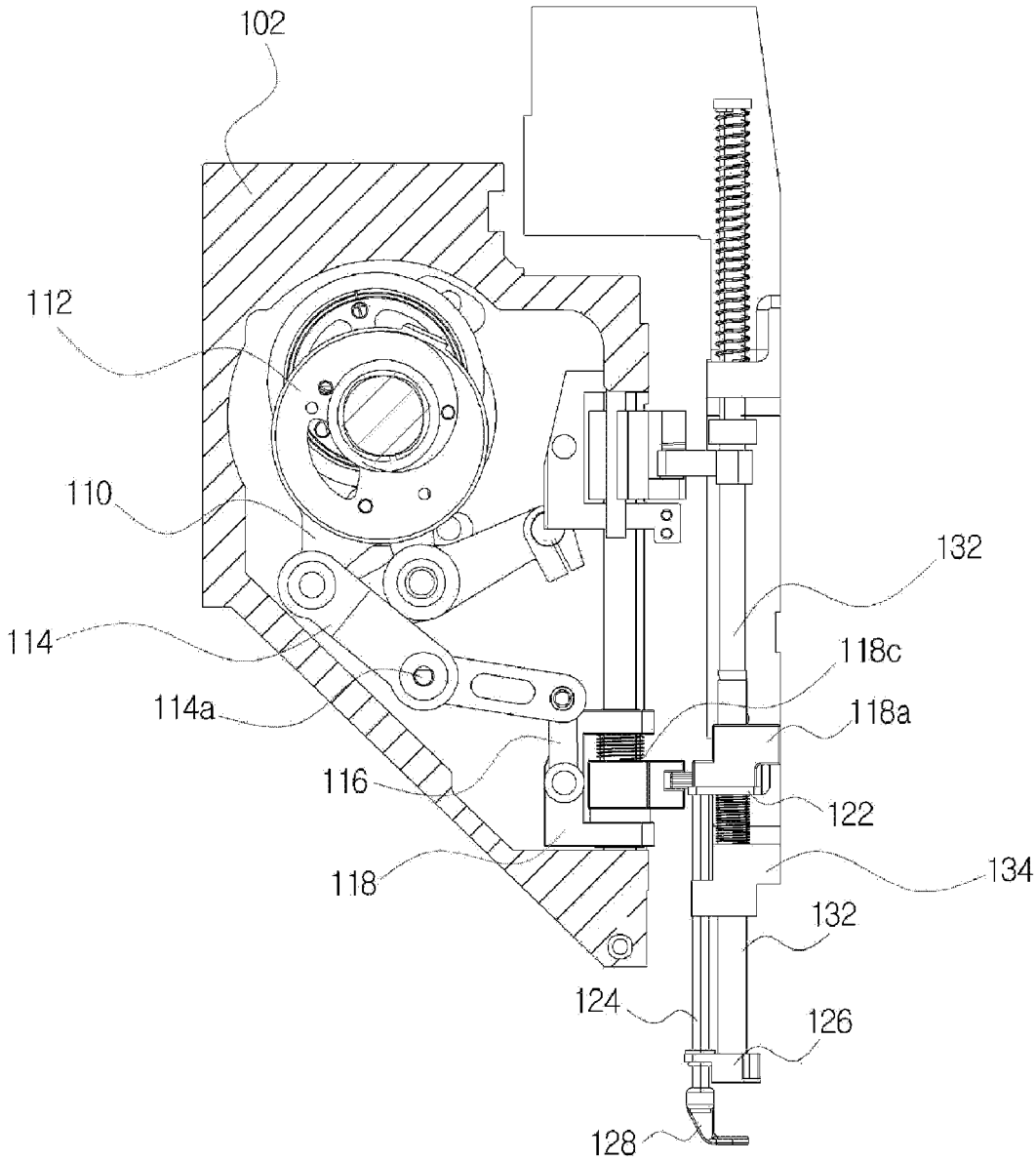
FIG. 5 is a side elevation view illustrating the drive structure for a presser foot according to the present invention, in the mounted position.

FIG. 3 is a perspective view illustrating a sewing head having a drive structure for a presser foot according to an embodiment of the present invention, FIG. 4A is a perspective view illustrating the drive structure for a presser foot according to the present invention, FIG. 4B is an expanded view of part "B" of FIG. 4A, seen from one direction, FIG. 4C is an expanded view of part "B" of FIG. 4A, seen from the other direction, and FIG. 5 is a side elevation view illustrating the drive structure for a presser foot according to the present invention, in the mounted position.

Referring to FIGS. 3 to 5, the embroidery machine of the present invention is constructed in such a fashion that each of the needle bar and the presser foot is actuated by an independent drive mechanism.

In the drive structure for a presser foot, as shown in FIGS. 4A to 5, a rotation driving force from an upper shaft motor (not shown) rotates a presser foot drive cam 112, which is fastened to the outer circumference of an upper shaft 104, which extends through a sewing arm 102.

Then, a presser foot driving power transmission unit rocks in cooperation with the rotation of the presser foot drive cam 112, and a presser foot 128, which is connected to the presser foot driving power transmission unit, vertically rocks in cooperation with the presser foot driving power transmission unit.

Here, in the presser foot driving power transmission unit, a presser foot drive cam transmission member 110 vertically reciprocates in cooperation with the rotation of the presser foot drive cam 112, a presser foot drive lever 114, which is connected to the presser foot drive cam transmission member 110, vertically pivots about the pivot point 114*a* of the central portion, and a presser foot drive link 116 vertically reciprocates according to the amount that the presser foot drive lever 114 pivots.

A presser foot drive block 118 also reciprocally moves along a needle bar guide shaft 130 according to the amount of vertical movement of the presser foot drive link 116.

According to this embodiment of the present invention, the presser foot drive cam transmission member 110 is implemented with a presser foot drive rod, which is coupled to the outer circumference of the presser foot drive cam 112, thereby rotatably housing the presser foot drive cam 112 therein, and thus vertically reciprocates according to the amount of eccentricity of the presser foot drive cam 112, which rotates in cooperation with the rotation of the upper shaft 104.

It should be understood, however, that the presser foot drive cam transmission member 110 of the present invention is not limited to the above-mentioned structure, but may be implemented with a cam roller (not shown), which contacts a cam follow, that is, a grooved track in the presser foot drive cam 112.

The presser foot drive lever 114 is pivotally connected, at a first end thereof, to the lower end of the presser foot drive cam transmission member 110, and is connected, at a second end thereof, to the presser foot drive link 116, so that the two ends of the presser foot drive lever 114 reciprocally pivot around the pivot point 114*a* of the central portion according to the amount of vertical movement of the presser foot drive cam transmission member 110.

The presser foot drive link 116 is rotatably connected, at a first end thereof, to the second end of the presser foot drive lever 114, and is pivotally connected, at a second end thereof, to the presser foot drive block 118, so that it can vertically reciprocate according to the amount that the presser foot drive lever 114 pivots.

A presser foot holder 118*a* is coupled to the outer circumference of the needle bar 132 to be vertically slidable, and is fastened to a presser foot holder gripper 118*b*, which is disposed inside the presser foot drive block 118. The presser foot drive block 118 is also connected to the second end of the presser foot drive link 116. Accordingly, the presser foot drive block 118 can vertically reciprocate according to the amount of vertical movement of the presser foot drive link 116.

A buffer spring 118*c* having a predetermined amount of elasticity is housed, together with the presser foot holder gripper 118*b*, inside the presser foot drive block 118 in such a fashion that the buffer spring 118*c* can vertically reciprocate on the outer circumference of the needle bar guide shaft 130 while constantly pressing the presser foot holder gripper 118*b*. This, as a result, makes it possible to prevent both the presser foot holder 118*a* and the presser foot holder gripper 118*b* from being damaged by an unexpected malfunction of the presser foot 128.

Figure 1:
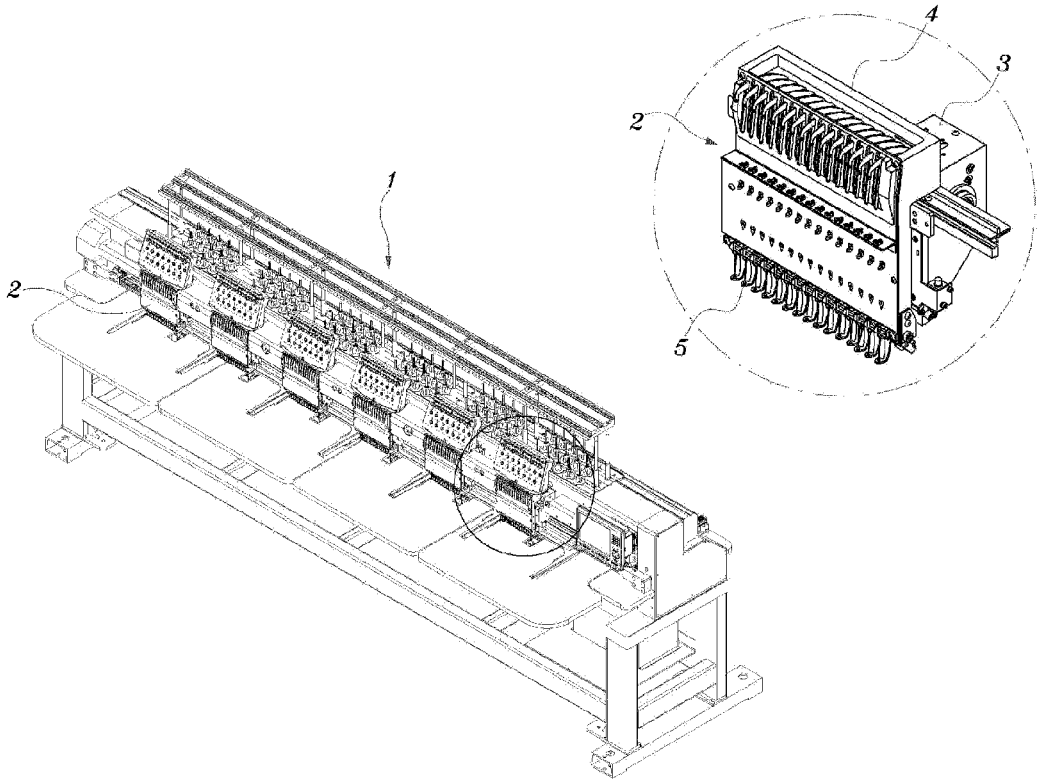
FIG. 1 is a perspective view illustrating of the embroidery machine and partially expanded view of sewing head.
Figure 2A:
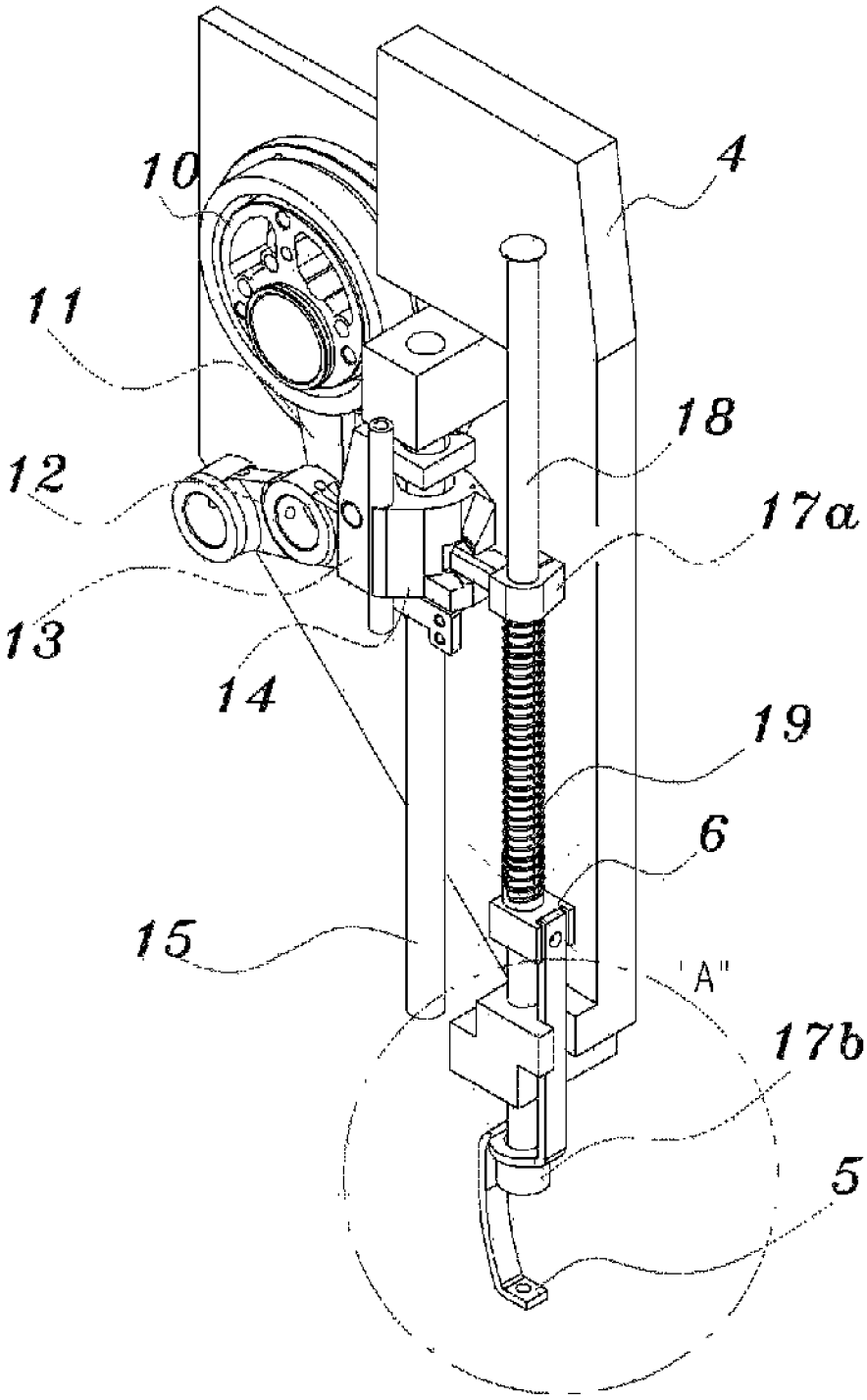
FIG. 2A is a perspective view illustrating a drive structure for a presser foot and a needle bar of the embroidery machine of the prior art.
Figure 2B:
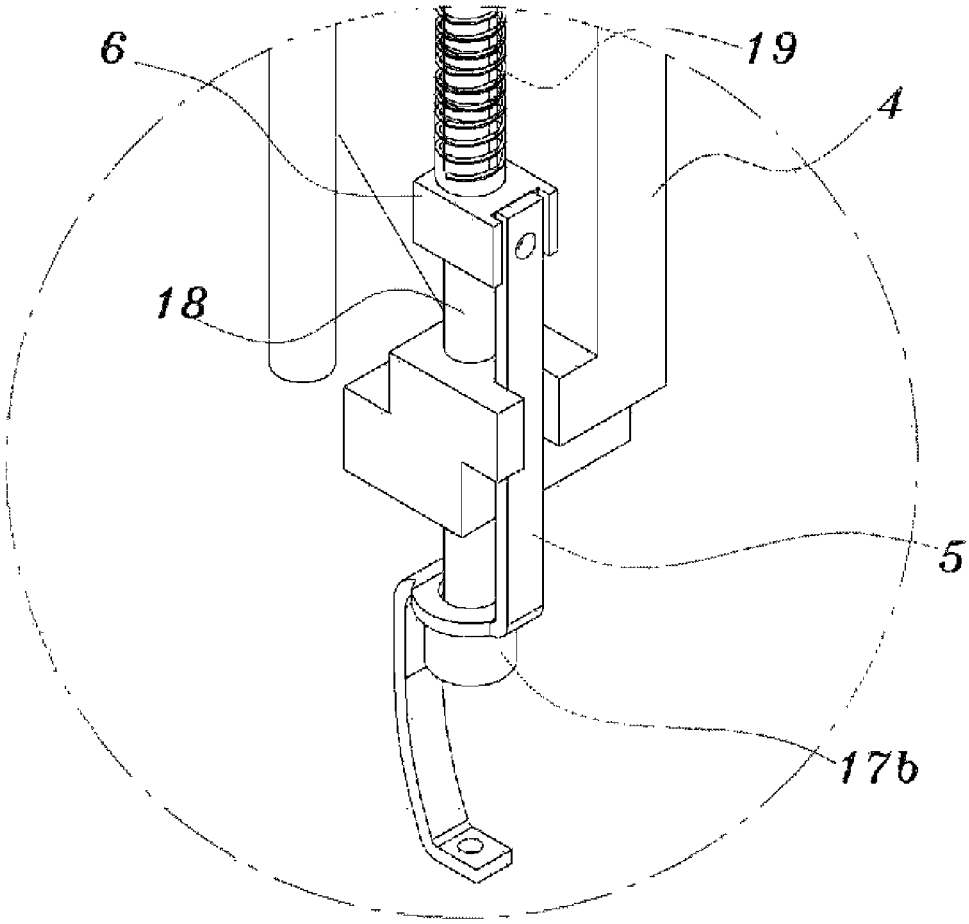
FIG. 2B is an expanded view of part "A" of FIG. 2A.

Here, like the above-mentioned needle control block (see the reference number 14 in FIG. 2A), the presser foot holder gripper 118*b* can be set to pivot about the needle bar guide shaft 130 inside the presser foot drive block 118 so as to couple with or decouple from the presser foot holder 118*a*, or, on the contrary, can be fixed so as not to pivot.

The presser foot holder 118*a*, coupled with the presser foot holder gripper 118*b*, is set to be vertically reciprocable on the outer circumference, and is coupled, at one portion thereof, with a presser foot assembly 120.

The presser foot assembly 120 has a presser foot guide bushing 122, which is fastened to the presser foot holder 118*a*, and a presser foot support 124, which is fixedly coupled with the bottom of the presser foot guide bushing 122. The presser foot support 124 is arranged to be parallel to the needle bar 132, and is coupled, at the bottom thereof, with the presser foot 128.

The presser foot assembly 120 also includes an additional coupling bushing 126, which fixedly holds both the lower end of the presser foot support 124 and the lower end of the needle bar 132. The presser foot 128 is detachably coupled to the lower end of the presser foot support 124 via suitable fasteners, such as male and female threads, so that it can be freely mounted to and removed from the presser foot support 124. In FIG. 3, reference number 134, which is not described, indicates a needle bar support case.

The drive structure for a presser foot according to this embodiment of the present invention will be described more fully with reference to the accompanying drawings.

When the upper shaft 104 rotates using the rotation driving force of the upper motor (not shown), the presser foot drive cam 112, coupled to the upper shaft 104, rotates in cooperation therewith. In response to the rotation of the presser foot drive cam 112, the presser foot drive cam transmission member 110 vertically reciprocates according to the amount of eccentricity of the presser foot drive cam 112.

As the presser foot drive cam transmission member 110 moves vertically, the presser foot drive lever 114, connected to the lower end of the presser foot drive cam transmission member 110, vertically pivots about the pivot point. In cooperation with this action, the presser foot drive block 118, connected to the presser foot drive lever 114 via the presser foot drive link 116, vertically reciprocates on the needle bar guide shaft 130.

As the presser foot drive block 118 moves vertically, the presser foot holder 118*a*, fastened to the presser foot holder gripper 118*b*, which is housed inside the presser foot drive block 118, vertically moves in cooperation with the presser foot drive block 118. In cooperation with this action, the presser foot assembly 120, fastened to the presser foot holder 118*a*, also moves vertically.

Furthermore, the needle bar 132, connected to the bottom of the presser foot holder 118*a*, which is fastened to the presser foot drive block 118, vertically moves inside the sewing head 100, and the presser foot 128, coupled to the lower end of the presser foot support 124, also vertically operates.

Figure 6A:
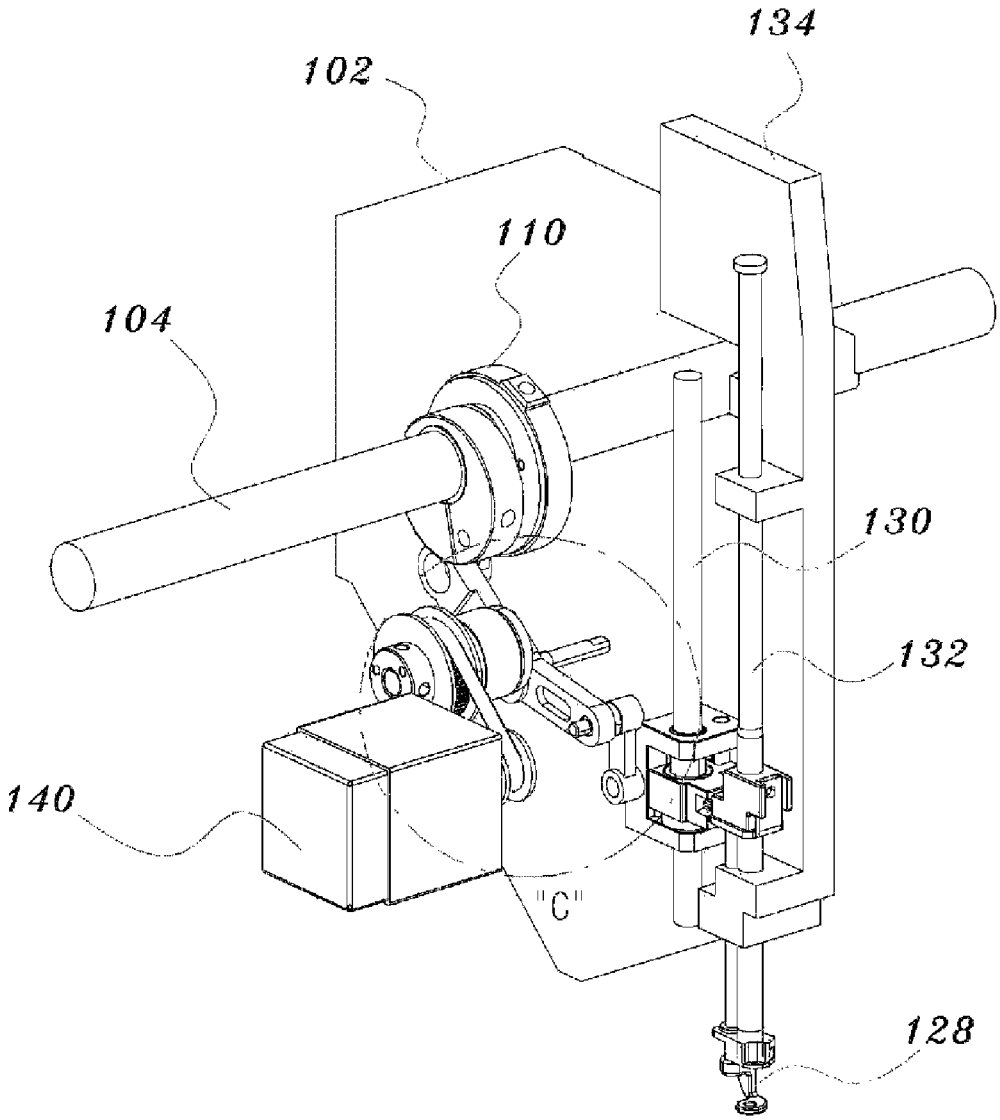
FIG. 6A is a perspective view illustrating the drive structure for a presser foot having a height adjustment mechanism according to the present invention.
Figure 6B:
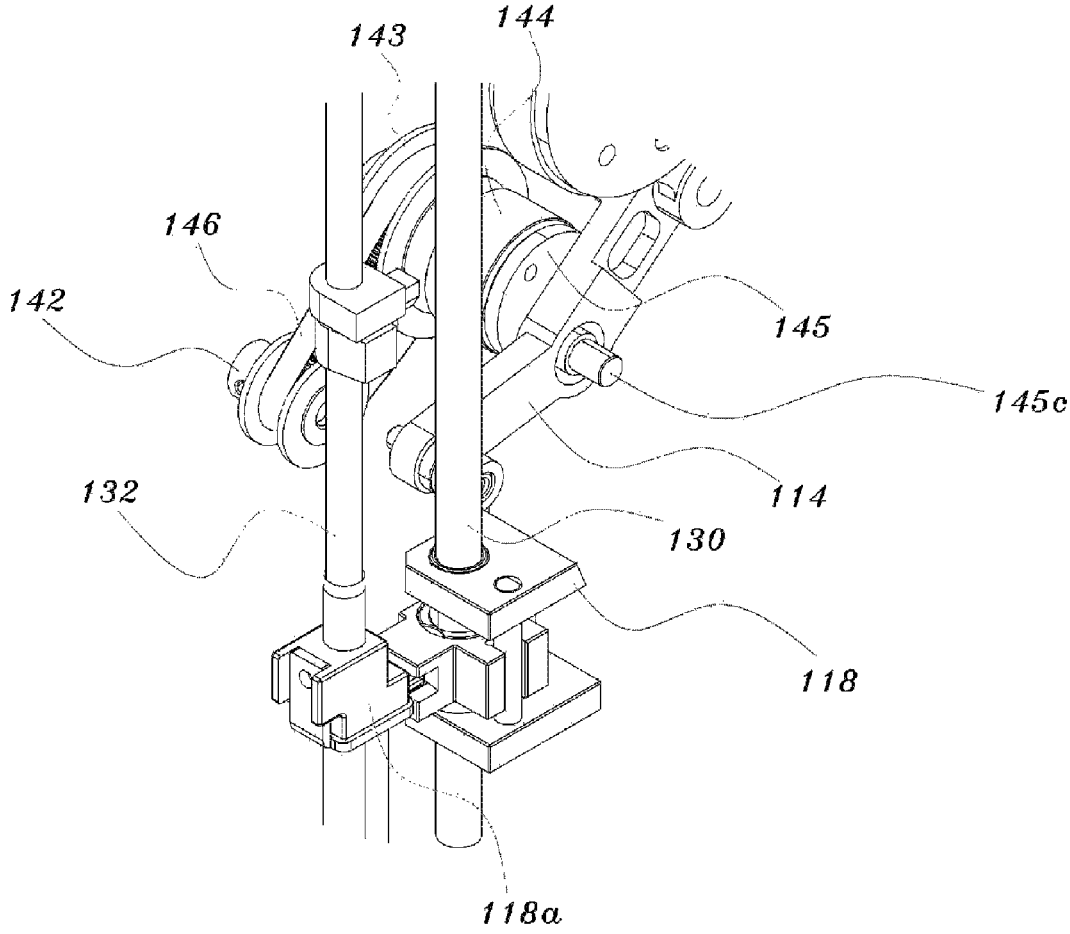
FIG. 6B is an expanded view of part "C" of FIG. 6A.
Figure 6C:
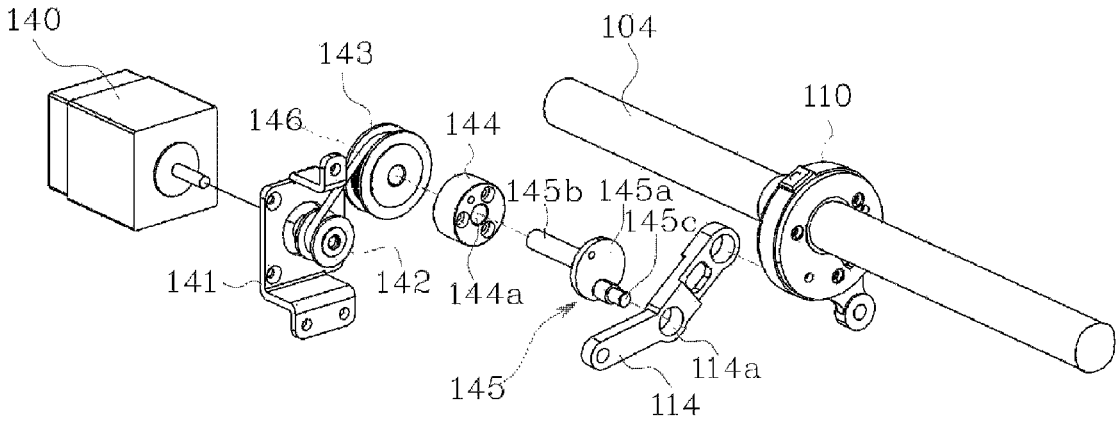
FIG. 6C is an expanded perspective view illustrating the construction of the height adjustment mechanism of an embroidery machine according to the present invention.

FIG. 6A is a perspective view illustrating the drive structure for a presser foot having a height adjustment mechanism according to the present invention, FIG. 6B is an expanded view of part "C" of FIG. 6A, and FIG. 6C is an expanded perspective view illustrating the construction of the height adjustment mechanism of a sewing machine according to the present invention.

Referring to FIGS. 6A to 6C, the height adjustment mechanism of the present invention acts to displace the pivot point of the presser foot drive lever 114 in a predetermined direction, thereby adjusting the upper dead point and the lower dead point of the presser foot 128, and includes a drive motor 140, a drive pulley 142, operably coupled with the drive motor 140, a follower pulley 143, which is connected to and rotates following the drive pulley 142, and an eccentric member 145, which displaces the pivot point of the presser foot drive lever 114 using the driving force of the drive motor 140.

The drive motor 140 has a motor shaft protruding from one face thereof, and the front face of a case storing the drive motor 140 is bolt-fastened to one face of the sewing arm 102 via a connector bracket 141, which has a U-shaped cross section when seen from the front.

The drive pulley 142 is attached to the motor shaft of the drive motor 140, and is connected, via a belt 146, to the follower pulley 143, which has a larger diameter. The eccentric member 145 extends through both a hollow space 144*a* of a cylindrical eccentric member support 144 and a hole of the follower pulley 143, and is then connected to the follower pulley 143.

While the drive pulley 142 and the follower pulley 143 are connected to each other via the belt 146 in this embodiment of the present invention, they may be directly meshed with each other.

The eccentric member 145 has a cylindrical body 145*a*, a drive shaft 145*b*, which protrudes from one face of the cylindrical body 145*a*, and a fastening protrusion 145*c*, which is formed in the opposite face of the cylindrical body 145*a* and eccentrically protrudes from the center thereof. The eccentric member 145 is connected, at the drive shaft 145*b*, to the follower pulley 143, and at the meshing protrusion 145*c*, to the pivot point 114*a* of the presser drive lever 114, so that the pivot point 114*a* of the presser foot drive lever 114 can be displaced upward or downward by the eccentric member 145.

According to the present invention, the position of the upper and lower dead points of the presser foot 128 can be easily and correctly controlled, since the pivot point 114*a* of the presser foot drive lever 114 can be displaced upward or downward through the control of the drive motor 140. Accordingly, this makes it possible to automatically control a sewing operation in response to the thickness of a sheet of cloth to be sewn.

That is, in the case where the presser foot 128 is required to be raised to a predetermined height, the drive pulley 142 rotates in response to the counterclockwise rotation of the drive motor 140. The rotation of the drive pulley 142 is transmitted to the follower pulley 143, and then, through the eccentric member support 144 and the eccentric member 145, to the presser foot drive lever 114.

Furthermore, the transmission of the rotation, as described above, acts to raise the presser foot drive block 118 through the presser foot drive link 116. In response to the upward movement of the needle bar 132, connected to the presser foot holder 118*a*, which is fastened to the presser foot drive block 118, the presser foot 128 also rises to a predetermined height.

In the opposite case, where the presser foot 128 is about to descend to a predetermined height, a rotational force from clockwise operation of the drive motor 140 acts, through the presser foot drive link 116, on the presser foot 118, thereby causing the presser foot 118 to descend. Then, the needle bar 132, connected to the presser foot holder 118*a*, moves downward, and, in response to this descent, the presser foot 128 also moves downward.

Accordingly, the presser foot height adjustment mechanism makes it possible to adjust the height of the lower end point of the presser foot 128 according to the thickness of the sheet of cloth to be sewn. That is, it is possible to adjust the height of the presser foot 128 by displacing the pivot point 114*a* of the presser foot drive lever 114.

In a sewing operation, when a sheet of cloth to be sewn is relatively thick, the height adjustment mechanism is operated to raise the height of the lower dead point of the presser foot 128. When the sheet of cloth to be sewn is relatively thin, the height adjustment mechanism is operated to lower the height of the lower dead point of the presser foot 128.

A program can be used to automatically control the drive motor 140 according to the thickness of the sheet of cloth to be sewn. For example, in the case where a sewing pattern is inputted, an embroidery stitch frame, to which fabric is fixed, is slightly moved in x-axis and y-axis directions, followed by manually determining the position at which the thickness of the sheet of cloth is changed.

Then, the determined position and the height of the presser foot 128 from a needle plate (not shown) at the determined position (or the number of drive pulses inputted to the drive motor) are inputted as data, or rather than the input data, the number of needles up to the position where the thickness of the sheet of cloth changes is set.

Accordingly, in a sewing operation, when the position where the thickness of the sheet of cloth changes is reached, the number of pulses (or the number of needles) is supplied according to the height inputted to the drive motor 140, so that the lower end point of the presser foot 128 can be automatically controlled.

According to the invention as set forth above, the presser foot is driven by a separate drive structure, independently from the needle bar, so that the moving track of the presser foot can be freely generated, and thus the stroke or the lower end point of the presser foot can be freely produced.

Furthermore, the height adjustment mechanism can adjust the height of the presser foot according to the type or thickness of a sheet of cloth to be sewn, thereby enhancing the efficiency of an embroidery machine operation.

While the embroidery machine of the present invention has been described with reference to the particular illustrative embodiments and the accompanying drawings, it is not to be limited thereto. It is to be appreciated that those skilled in the art can substitute, change or modify the embodiments in various forms without departing from the scope and spirit of the present invention.

What is claimed is:

1. An embroidery machine, which includes a sewing arm having an upper shaft for providing a driving force, a needle bar support case, which is assembled to a front portion of the sewing arm so as to be laterally movable, a needle bar provided in a needle bar support case, the needle bar having a needle at a lower end thereof and vertically carrying the needle using a rotation driving force of the upper shaft, and a presser foot, which is provided in the needle bar support case so as to be vertically movable, characterized in that each of the needle bar and the presser foot is operated by an individual drive mechanism, wherein the presser foot drive mechanism includes: a presser foot drive cam, which is fastened to the upper shaft so as to be rotated thereby; a presser foot drive cam transmission member, which is coupled with an outer circumference of the presser foot drive cam so as to be rocked thereby; a presser foot drive lever, which is connected to the presser foot drive transmission member so as to vertically pivot about a pivot point; a presser foot drive link, which vertically reciprocates according to the amount that the presser foot drive lever pivots; and a presser foot drive block, which reciprocates along a needle bar guide shaft in cooperation with vertical movement of the presser foot drive link.

2. The embroidery machine according to claim 1, wherein the presser foot drive cam transmission member is a cam roller, which is in contact with a cam follower, the cam follower provided on the presser foot drive cam.

3. The embroidery machine according to claim 1, wherein the presser foot drive cam transmission member is a drive rod, which is coupled with the outer circumference of the presser foot drive cam.

4. The embroidery machine according to claim 1, wherein the presser foot drive block further includes a presser foot holder gripper, which is fastened to a presser foot holder, wherein the presser foot holder is coupled with an outer circumference of the needle bar so as to be vertically slidable thereon.

5. The embroidery machine according to claim 1, wherein the presser foot drive block includes a buffer spring, which is coupled with an outer circumference of the needle bar guide shaft so as to be vertically reciprocable thereon together with the presser foot holder gripper.

6. The embroidery machine according to claim 4 or 5, wherein the presser foot holder gripper is installed inside the presser foot drive block so as to be rotatable about the needle bar guide shaft, thereby being capable of coupling with or decoupling from the presser foot.

7. The embroidery machine according to claim 4, wherein the presser foot holder is connected to a presser foot assembly, which is provided parallel to the needle bar and is vertically movable.

8. The embroidery machine according to claim 7, wherein the presser foot assembly includes: a presser foot guide bushing, which is fastened to the presser foot holder; and a presser foot support, which is coupled at an upper end thereof with the presser foot guide bushing and at a lower end thereof with the presser foot.

9. The embroidery machine according to claim 8, wherein the presser foot assembly further includes a coupling bushing, which supports and fixes both the presser foot support and the needle bar.

10. The embroidery machine according to claim 8 or 9, wherein the presser foot is detachably coupled with the lower end of the presser foot support.

11. The embroidery machine according to claim 1, wherein the presser foot drive mechanism further includes a presser foot height adjustment mechanism, which displaces the pivot point of the presser foot drive lever in a predetermined direction, thereby adjusting the height of an upper end point or a lower end point of the presser foot.

12. The embroidery machine according to claim 11, wherein the presser foot height adjustment mechanism includes: a drive motor for generating a driving force; a drive pulley, which is operably coupled with a motor shaft of the drive motor; a follower pulley, which is connected to and rotates following the drive pulley; and an eccentric member having a drive shaft at one portion thereof and a fastening protrusion at an opposite central portion thereof, the fastening protrusion eccentrically protruding from the central portion, wherein the drive shaft is connected to the follower pulley and the fastening protrusion is connected to the pivot point of the presser foot drive lever, so that the eccentric member displaces the pivot point of the presser foot drive lever using the driving force from the drive motor.

13. The embroidery machine according to claim 12, wherein the presser foot height adjustment mechanism further includes an eccentric member support having a hollow space in a central portion thereof, through which the drive shaft of the eccentric member extends.

* * * * *